US005114451A

United States Patent [19]

Rambo et al.

[11] Patent Number: 5,114,451

[45] Date of Patent: * May 19, 1992

[54] LIQUEFIED NATURAL GAS PROCESSING

[75] Inventors: C. L. Rambo; John D. Wilkinson; Hank M. Hudson, all of Midland, Tex.

[73] Assignee: Elcor Corporation, Dallas, Tex.

[ * ] Notice: The portion of the term of this patent subsequent to Dec. 26, 2006 has been disclaimed.

[21] Appl. No.: 492,548

[22] Filed: Mar. 12, 1990

[51] Int. Cl.[5] ..... F25J 3/02

[52] U.S. Cl. ..... 62/24; 62/11; 62/32; 62/44

[58] Field of Search ..... 62/11, 9, 23, 24, 38, 62/42, 44

[56] References Cited

U.S. PATENT DOCUMENTS

| | | | |
|---|---|---|---|
| 2,952,984 | 9/1960 | Marshall, Jr. | 62/ |
| 3,837,172 | 9/1974 | Markbreiter et al. | 62/ |
| 4,140,504 | 2/1979 | Campbell et al. | 62/23 X |
| 4,285,708 | 8/1981 | Politte et al. | 62/23 X |
| 4,368,061 | 1/1983 | Mestrallet et al. | 62/24 X |
| 4,687,499 | 8/1987 | Aghili | 62/32 X |
| 4,714,487 | 12/1987 | Rowles | 62/44 X |
| 4,752,312 | 6/1988 | Prible | 62/44 X |
| 4,851,020 | 7/1989 | Montgomery, IV | 62/24 |
| 4,854,955 | 8/1989 | Campbell et al. | 62/24 |
| 4,889,545 | 12/1989 | Campbell et al. | 62/24 |
| 4,966,612 | 10/1990 | Bauer | 62/24 |

*Primary Examiner*—Henry A. Bennet
*Assistant Examiner*—Christopher B. Kilner
*Attorney, Agent, or Firm*—Brumbaugh, Graves, Donohue & Raymond

[57] ABSTRACT

A process for the recovery of ethane, ethylene, propane, propylene and heavier hydrocarbons from a liquefied natural gas (LNG) stream is disclosed. At least a portion of the LNG feed stream is directed in heat exchange relation with a compressed recycle portion of the fractionation tower overhead, with the warmed LNG stream thereafter supplied to the fractionation tower at a mid-column feed position. The recycle stream is cooled by the LNG stream sufficiently to substantially condense it, and the substantially condensed recycle stream is then supplied to the column at a top column feed position to serve as reflux for the tower. The pressure of the recycle stream and the quantities and temperatures of the feeds to the column are effective to maintain the column overhead temperature at a temperature whereby the major portion of said desired components is recovered in the bottom liquid product from the column.

14 Claims, 4 Drawing Sheets

LIQUEFIED NATURAL GAS PROCESSING

BACKGROUND OF THE INVENTION

This invention relates to a process for the separation of ethane and heavier hydrocarbons from liquefied natural gas, hereinafter referred to as LNG, to provide a volatile methane-rich residue gas stream and a less volatile natural gas liquids (NGL) stream.

As an alternative to transportation in pipelines, natural gas at remote locations is sometimes liquefied and transported in special LNG tankers to appropriate LNG handling and storage terminals. The LNG can then be revaporized and used as a gaseous fuel in the same fashion as natural gas. Although LNG usually has a major proportion of methane, i.e. methane comprises at least 50 mole percent of the LNG, it also contains relatively lesser amounts of heavier hydrocarbons such as ethane, propane, butanes and the like, as well as nitrogen. It is often necessary to separate some or all of the heavier hydrocarbons from the methane in the LNG so that the gaseous fuel resulting from vaporizing the LNG conforms to pipeline specifications for heating value. In addition, it is also often desirable to separate the heavier hydrocarbons from the methane because these hydrocarbons have a higher value as liquid products (for use as petrochemical feedstocks, as an example) than their value as fuel.

Although there are many processes which may be used to separate ethane and heavier hydrocarbons from LNG, these processes often must compromise between high recovery and process simplicity (and hence low capital investment). In U.S. Pat. No. 2,952,984 Marshall describes an LNG process capable of very high ethane recovery via the use of a refluxed distillation column. Markbreiter describes in U.S. Pat. No. 3,837,172 a simpler process using a non-refluxed fractionation column, limited to lower ethane recoveries.

The present invention is generally concerned with the recovery of ethylene, ethane, propylene, propane and heavier hydrocarbons from such LNG streams. It uses a novel process arrangement to allow high ethane recovery while keeping the processing equipment simple and the capital investment low.

DESCRIPTION OF THE PREFERRED EMBODIMENT

Figure 1:
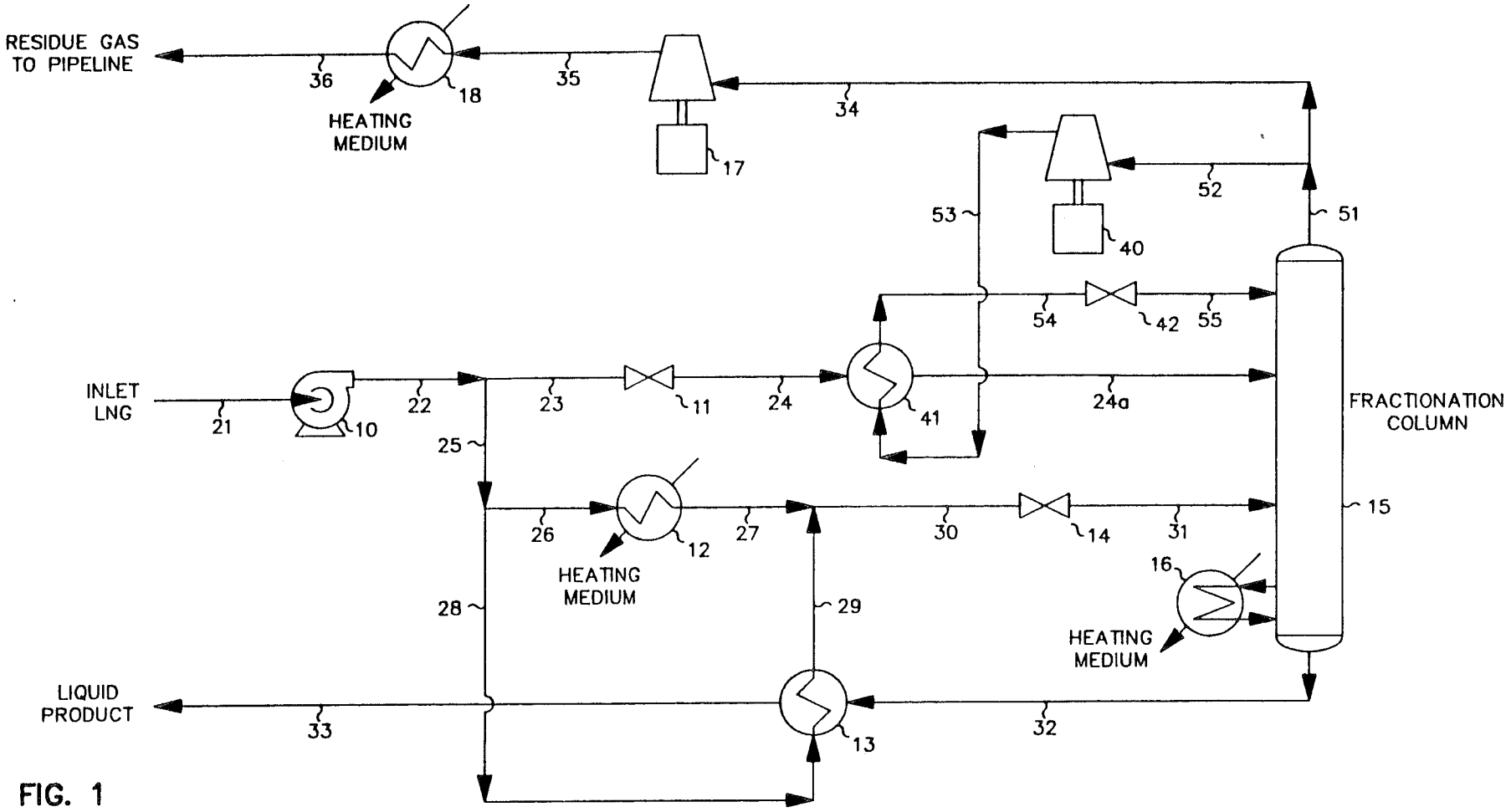
FIG. 1 discloses a flow diagram of an LNG processing plant in accordance with the present invention.

Referring to FIG. 1, the incoming LNG to be processed (stream 21) enters pump 10, which elevates its pressure sufficiently so that the LNG can flow through heat exchangers and thence to a fractionation column. Stream 22 exiting the pump is typically split into two portions, streams 23 and 25. The second portion in stream 25 is often heated prior to entering the fractionation column 15 so that all or a portion of it is vaporized, which reduces the amount of liquid flowing down fractionation column 15 and allows the use of a smaller diameter column. In the example shown in FIG. 1, stream 25 is heated in two heat exchangers by being split into two streams, 26 and 28. Stream 26 is heated using an external heat source in exchanger 12 to produce stream 27, and stream 28 is heated while cooling the liquid product from the column in heat exchanger 13 to produce stream 29. Streams 27 and 29 recombine as stream 30, are reduced in pressure by valve 14, and flow to a mid-column feed point on fractionation column 15 as stream 31.

The proportion of the total feed in stream 22 flowing to the column as stream 23 is controlled by valve 11, and is typically less than 50% of the total feed. Stream 24 flows from valve 11 to heat exchanger 41 where it is heated as it cools, substantially condenses, and subcools stream 53. The heated stream 24a then flows to fractionation column 15 at an upper mid-column feed position.

Fractionation column 15, commonly referred to as a demethanizer, is a conventional distillation column containing a plurality of vertically spaced trays, one or more packed beds, or some combination of trays and packing. The trays and/or packing provide the necessary contact between the liquids falling downward in the column and the vapors rising upward. The demethanizer also includes heat inputs, such as reboiler 16, which heat and vaporize a portion of the liquids flowing down the column to provide the stripping vapors which flow up the column. These vapors strip the methane from the liquids, so that the bottom liquid product, stream 32, is substantially devoid of methane and comprised of the majority of the $C_2$ components and heavier hydrocarbons contained in the LNG feed stream. After cooling in exchanger 13, the liquid product, stream 33, flows to storage or further processing.

The demethanizer overhead stream, stream 51, is divided into two portions. The major portion, stream 34, is the methane-rich residue gas. It is typically compressed to high pressure for distribution in pipelines, using equipment such as compressor 17 and heater 18 shown in FIG. 1, to produce residue gas stream 36.

The minor portion of the tower overhead, stream 52, enters compressor 40, which supplies a modest boost in pressure to overcome the pressure drops in heat exchanger 41 and control valve 42, as well as the static head due to the height of demethanizer 15. The compressed stream 53 is cooled, substantially condensed, and subcooled by a portion of the LNG feed in heat exchanger 41 to produce stream 54. Stream 54 flows through valve 42 to lower its pressure to that of column 15, and resulting stream 55 flows to the top feed point of demethanizer 15 to serve as reflux for the tower.

DESCRIPTION OF AN ALTERNATE EMBODIMENT

It will be easily recognized by those skilled in the art that recycle compressor 40 in FIG. 1 need not be a separate compressor in order to apply the process depicted in FIG. 1. Instead, the function of compressor 40 could be consolidated into residue gas compressor 17, as illustrated in FIG. 2.

Figure 2:
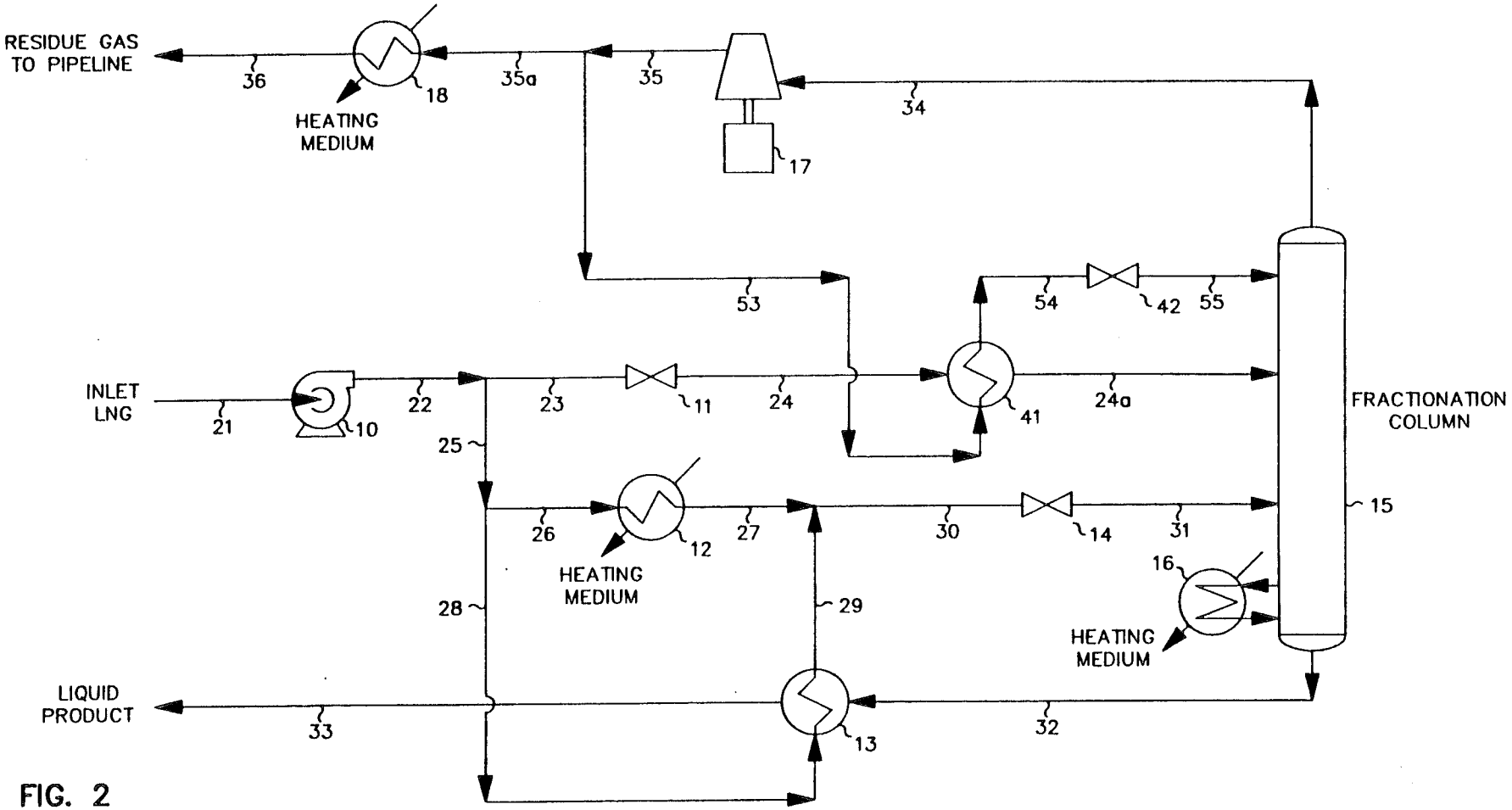
FIG. 2 discloses a flow diagram illustrating an alternative means of application of the present invention to an LNG processing plant.
Figure 3:
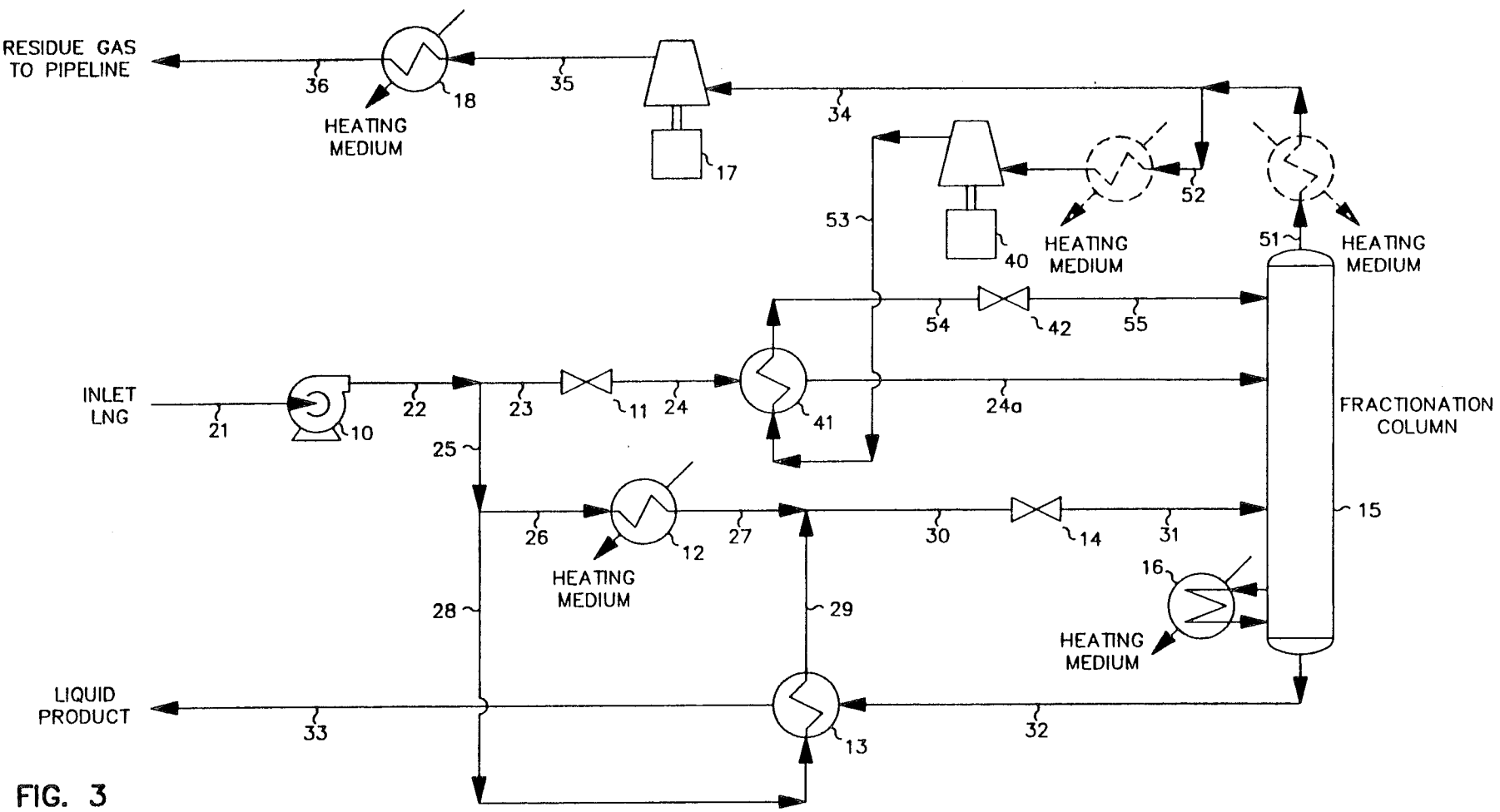
FIGS. 3 and 4 disclose flow diagrams illustrating other alternative means of application of the present invention to an LNG processing plant.
Figure 4:
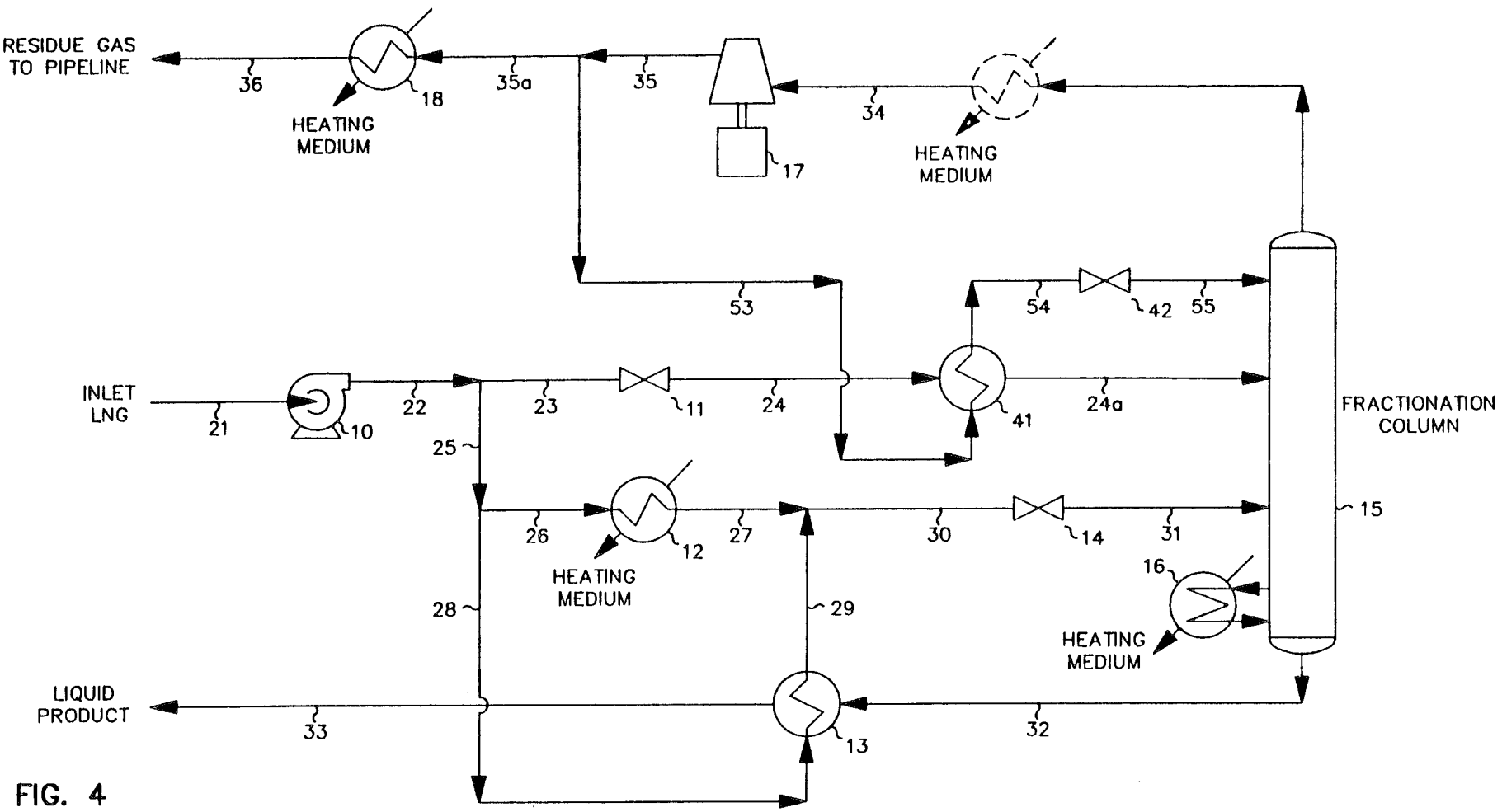

The flow scheme of the LNG feed streams shown in FIG. 2 is essentially the same as that contained in FIG. 1. The difference lies in the manner in which the tower overhead, stream 34, is divided to produce the methane-rich residue gas and the recycle stream.

The demethanizer overhead stream, stream 34, is compressed to pipeline pressure in compressor 17. The compressor discharge, stream 35, is divided into two portions. The major portion, stream 35a, is the methane-rich residue gas. It typically must be heated to ambient temperature by heater 18 before entering the pipeline distribution system as residue gas stream 36.

The minor portion of the compressed tower overhead, stream 53, is cooled, substantially condensed, and subcooled by a portion of the LNG feed in heat exchanger 41 to produce stream 54. Stream 54 flows through valve 42 to lower its pressure to that of column 15, and resulting stream 55 flows to the top feed point of demethanizer 15 to serve as reflux for the tower.

Whereas the recycle compressor 40 in FIG. 1 need supply only enough pressure rise to overcome the pressure drops of heat exchanger 41 and valve 42, plus any static head differences, compressor 17 in FIG. 2 typically must increase the gas pressure by several hundred pounds per square inch in order to meet pipeline delivery requirements. Consequently, the embodiment of the invention shown in FIG. 2 will usually require more compression horsepower than the preferred embodiment shown in FIG. 1. However, the elimination of the recycle compressor may lower the capital investment, particularly in small plants. The particular circumstances of each application will generally dictate which embodiment is better for a specific plant.

Depending on the size and availability of compression equipment, it may be desirable to heat the gas stream to be compressed in either the FIG. 1 or the FIG. 2 embodiment. Heating the gas prior to compression may eliminate the need for special, low temperature metallurgy in the compression equipment, which can offer lower capital investment (depending on plant size and other factors).

Through these novel methods of generating reflux for the demethanizer, the present invention can achieve the high recovery offered by Marshall using simpler, less expensive processing equipment. The present invention is only slightly more complex than Markbreiter, but offers substantially higher recovery of the $C_2$ components and heavier hydrocarbons contained in the LNG.

The invention can also be used when it is desirable to recover only the $C_3$ components and heavier components ($C_2$ component rejection). This can be accomplished by appropriate adjustment of the recycle stream flow rate, the column feed rates and the column operating conditions. In particular, rejecting $C_2$ components to the column overhead requires increasing the duty of reboiler 16 to raise the temperature of stream 32 and thereby strip the $C_2$ components from the column bottom product.

It also should be noted that valve 14 could be replaced with an expansion engine (turboexpander) whereby work could be extracted from the pressure reduction of stream 30. In this case, the LNG (stream 22) must be pumped to a higher pressure so that work extraction is feasible. This work could be used to provide power for pumping the LNG stream, for compression of the recycle stream or the residue gas, or to generate electricity. The choice between use of a valve or an expansion engine will depend on the particular circumstances of each LNG processing project.

While there have been described what are believed to be the preferred embodiments of the invention, those skilled in the art will recognize that other and further modifications may be made thereto, e.g. to adapt the invention to various conditions, types of feeds, or other requirements, without departing from the spirit of the present invention as defined by the following claims:

We claim:

1. In a process for the separation of liquefied natural gas containing methane, $C_2$ components, $C_3$ components and heavier hydrocarbon components, in which process (a) said liquefied natural gas stream is supplied to a fractionation column in one or more feed streams; and (b) said liquefied natural gas is fractionated into a more volatile fraction containing a major portion of said methane and a relatively less volatile fraction containing a major portion of said $C_2$ components, $C_3$ components and heavier hydrocarbon components;

the improvement wherein (1) a distillation stream is withdrawn from an upper region of said fractionation column and thereafter divided into said more volatile fraction and a recycle stream;

(2) said recycle stream is compressed and thereafter said compressed recycle stream is directed in heat exchange relation with at least a portion of said liquefied natural gas whereby said compressed recycle stream is cooled sufficiently to substantially condense it, while said liquefied natural gas portion is heated;

(3) said substantially condensed compressed recycle stream is supplied to said fractionation column at a top column feed position;

(4) said heated liquefied natural gas portion is supplied to said fractionation column at a mid-column feed position; and (5) the quantity and pressure of said compressed recycle stream and the temperatures of said feed streams to said fractionation column are effective to maintain column overhead temperature at a temperature whereby the major portion of said $C_2$ components, $C_3$ components and heavier hydrocarbon components is recovered in said relatively less volatile fraction.

2. In a process for the separation of liquefied natural gas containing methane, $C_2$ components, $C_3$ components and heavier hydrocarbon components, in which process (a) said liquefied natural gas stream is supplied to a fractionation column in one or more feed streams; and (b) said liquefied natural gas is fractionated into a more volatile fraction containing a major portion of said methane and $C_2$ components and a relatively less volatile fraction containing a major portion of said $C_3$ components and heavier hydrocarbon components;

the improvement wherein (1) a distillation stream is withdrawn from an upper region of said fractionation column and thereafter divided into said more volatile fraction and a recycle stream;

(2) said recycle stream is compressed and thereafter said compressed recycle stream is directed in heat exchange relation with at least a portion of said liquefied natural gas whereby said compressed recycle stream is cooled sufficiently to substantially condense it, while said liquefied natural gas portion is heated;

(3) said substantially condensed compressed recycle stream is supplied to said fractionation column at a top column feed position;

(4) said heated liquefied natural gas portion is supplied to said fractionation column at a mid-column feed position; and (5) the quantity and pressure of said compressed recycle stream and the temperatures of said feed streams to said fractionation column are effective to maintain column overhead temperature at a temperature whereby the major portion of said $C_3$ components and heavier hydrocarbon components is recovered in said relatively less volatile fraction.

3. The improvement according to claim 1 or 2 wherein said distillation stream is heated prior to being divided into said more volatile fraction and said recycle stream.

4. The improvement according to claim 1 or 2 wherein said recycle stream is heated prior to compression.

5. In a process for the separation of liquefied natural gas containing methane, $C_2$ components, $C_3$ components and heavier hydrocarbon components, in which process (a) said liquefied natural gas is supplied to a fractionation column in one or more feed streams; and (b) said liquefied natural gas stream is fractionated into a more volatile fraction containing a major portion of said methane and a relatively less volatile fraction containing a major portion of said $C_2$ components, $C_3$ components and heavier hydrocarbon components;

the improvement wherein (1) a distillation stream is withdrawn from an upper region of said fractionation column and thereafter compressed to a higher pressure;

(2) said compressed distillation stream is divided into said more volatile fraction and a recycle stream;

(3) said recycle stream is directed in heat exchange relation with at least a portion of said liquefied natural gas whereby said recycle stream is cooled sufficiently to substantially condense it, while said liquefied natural gas portion is heated;

(4) said substantially condensed recycle stream is supplied to said fractionation column at a top column feed position;

(5) said heated liquefied natural gas portion is supplied to said fractionation column at a mid-column feed position; and (6) the quantity of said compressed recycle stream and the temperatures of said feeds to said fractionation column are effective to maintain column overhead temperature at a temperature whereby the major portion of said $C_2$ components, $C_3$ components and heavier hydrocarbon components is recovered in said relatively less volatile fraction.

6. In a process for the separation of liquefied natural gas containing methane, $C_2$ components, $C_3$ components and heavier hydrocarbon components, in which process (a) said liquefied natural gas is supplied to a fractionation column in one or more feed streams; and (b) said liquefied natural gas stream is fractionated into a more volatile fraction containing a major portion of said methane and $C_2$ components and a relatively less volatile fraction containing a major portion of said $C_3$ components and heavier hydrocarbon components;

the improvement wherein (1) a distillation stream is withdrawn from an upper region of said fractionation column and thereafter compressed to a higher pressure;

(2) said compressed distillation stream is divided into said more volatile fraction and a recycle stream;

(3) said recycle stream is directed in heat exchange relation with at least a portion of said liquefied natural gas whereby said recycle stream is cooled sufficiently to substantially condense it, while said liquefied natural gas portion is heated;

(4) said substantially condensed recycle stream is supplied to said fractionation column at a top column feed position;

(5) said heated liquefied natural gas portion is supplied to said fractionation column at a mid-column feed position; and (6) the quantity of said compressed recycle stream and the temperatures of said feeds to said fractionation column are effective to maintain column overhead temperature at a temperature whereby the major portion of said $C_3$ components and heavier hydrocarbon components is recovered in said relatively less volatile fraction.

7. The improvement according to claim 5 or 6 wherein said distillation stream is heated prior to compression.

8. In an apparatus for the separation of liquefied natural gas containing methane, $C_2$ components, $C_3$ components and heavier hydrocarbon components, in said apparatus there being (a) supply means to supply said liquefied natural gas to a fractionation column in one or more feed streams; and (b) a fractionation column connected to said supply means to receive said liquefied natural gas from said supply means and fractionate said liquefied natural gas into a more volatile fraction containing a major portion of said methane and a relatively less volatile fraction containing a major portion of said $C_2$ components, $C_3$ components and heavier hydrocarbon components;

the improvement wherein said apparatus includes (1) dividing means connected to said fractionation column to receive a distillation stream from an upper portion of said column and divide it into said more volatile fraction and a recycle stream;

(2) compressing means connected to said dividing means to receive said recycle stream and compress it to a higher pressure;

(3) heat exchange means connected to said compressing means to receive said compressed recycle stream and cool it sufficiently to substantially condense it, said heat exchange means being further connected (a) to said supply means to receive at least a portion of said liquefied natural gas and heat it, (b) to said fractionation column at a top column feed position to supply said substantially condensed compressed recycle stream to said column, and (c) to said fractionation column at a mid-column feed position to supply said heated liquefied natural gas portion to said column; and (4) control means adapted to regulate the quantity and pressure of said compressed recycle stream and the temperatures of said feed streams to said fractionation column to maintain column overhead temperature at a temperature whereby the major portion of said $C_2$ components, $C_3$ components and heavier hydrocarbon components is recovered in said relatively less volatile fraction.

9. In an apparatus for the separation of liquefied natural gas containing methane, $C_2$ components, $C_3$ components and heavier hydrocarbon components, in said apparatus there being (a) supply means to supply said liquefied natural gas to a fractionation column in one or more feed streams; and (b) a fractionation column connected to said supply means to receive said liquefied natural gas from said supply means and fractionate said liquefied natural gas into a more volatile fraction containing a major portion of said methane and $C_2$ components and a relatively less volatile fraction containing a major portion of said $C_3$ components and heavier hydrocarbon components;

the improvement wherein said apparatus includes (1) dividing means connected to said fractionation column to receive a distillation stream from an upper portion of said column and divide it into said more volatile fraction and a recycle stream;

(2) compressing means connected to said dividing means to receive said recycle stream and compress it to a higher pressure;

(3) heat exchange means connected to said compressing means to receive said compressed recycle stream and cool it sufficiently to substantially condense it, said heat exchange means being further connected (a) to said supply means to receive at least a portion of said liquefied natural gas and heat it, (b) to said fractionation column at a top column feed position to supply said substantially condensed compressed recycle stream to said column, and (c) to said fractionation column at a mid-column feed position to supply said heated liquefied natural gas portion to said column; and (4) control means adapted to regulate the quantity and pressure of said compressed recycle stream and the temperatures of said feed streams to said fractionation column to maintain column overhead temperature at a temperature whereby the major portion of said $C_3$ components and heavier hydrocarbon components is recovered in said relatively less volatile fraction.

10. The improvement according to claim 8 or 9 wherein said apparatus includes heating means connected to said fractionation column to receive said distillation stream and heat it, said heating means being further connected to said dividing means to supply said heated distillation stream thereto.

11. The improvement according to claim 8 or 9 wherein said apparatus includes heating means connected to said dividing means to receive said recycle stream and heat it, said heating means being further connected to said compressing means to supply said heated recycle stream thereto.

12. In an apparatus for the separation of liquefied natural gas containing methane, $C_2$ components, $C_3$ components and heavier hydrocarbon components, in said apparatus there being (a) supply means to supply said liquefied natural gas to a fractionation column in one or more feed streams; and (b) a fractionation column connected to said supply means to receive said liquefied natural gas from said supply means and fractionate said liquefied natural gas into a more volatile fraction containing a major portion of said methane and a relatively less volatile fraction containing a major portion of said $C_2$ components, $C_3$ components and heavier hydrocarbon components;

the improvement wherein said apparatus includes (1) compressing means connected to said fractionation column to receive a distillation stream from the upper region of said column and compress it to a higher pressure;

(2) dividing means connected to said compressing means to receive said compressed distillation stream and divide it into said more volatile fraction and a recycle stream;

(3) heat exchange means connected to said dividing means to receive said recycle stream and cool it sufficiently to substantially condense it, said heat exchange means being further connected (a) to said supply means to receive at least a portion of said liquefied natural gas and heat it, (b) to said fractionation column at a top column feed position to supply said substantially condensed recycle stream to said column, and (c) to said fractionation column at a mid-column feed position to supply said heated liquefied natural gas portion to said column; and (4) control means adapted to regulate the quantity of said recycle stream and the temperatures of said feed streams to said fractionation column to maintain column overhead temperature at a temperature whereby the major portion of said $C_2$ components, $C_3$ components and heavier hydrocarbon components is recovered in said relatively less volatile fraction.

13. In an apparatus for the separation of liquefied natural gas containing methane, $C_2$ components, $C_3$ components and heavier hydrocarbon components, in said apparatus there being (a) supply means to supply said liquefied natural gas to a fractionation column in one or more feed streams; and (b) a fractionation column connected to said supply means to receive said liquefied natural gas from said supply means and fractionate said liquefied natural gas into a more volatile fraction containing a major portion of said methane and $C_2$ components and a relatively less volatile fraction containing a major portion of said $C_3$ components and heavier hydrocarbon components;

the improvement wherein said apparatus includes (1) compressing means connected to said fractionation column to receive a distillation stream from the upper region of said column and compress to a higher pressure;

(2) dividing means connected to said compressing means to receive said compressed distillation stream and divide it into said more volatile fraction and a recycle stream;

(3) heat exchange means connected to said dividing means to receive said recycle stream and cool it sufficiently to substantially condense it, said heat exchange means being further connected (a) to said supply means to receive at least a portion of said liquefied natural gas and heat it, (b) to said fractionation column at a top column feed position to supply said substantially condensed recycle stream to said column, and (c) to said fractionation column at a mid-column feed position to supply said heated liquefied natural gas portion to said column; and (4) control means adapted to regulate the quantity of said recycle stream and the temperatures of said feed streams to said fractionation column to maintain column overhead temperature at a temperature whereby the major portion of said $C_3$ components and heavier hydrocarbon components is recovered in said relatively less volatile fraction.

14. The improvement according to claim 12 or 13 wherein said apparatus includes heating means connected to said fractionation column to receive said distillation stream and heat it, said heating means being further connected to said compressing means to supply said heated distillation stream thereto.

* * * * *